US009771884B2

(12) United States Patent
Burleigh et al.

(10) Patent No.: US 9,771,884 B2
(45) Date of Patent: Sep. 26, 2017

(54) SYSTEM AND METHOD FOR CONTROLLING THE AMOUNT OF PURGE FLUID DELIVERED TO CYLINDERS OF AN ENGINE BASED ON AN OPERATING PARAMETER OF A PURGE PUMP

(71) Applicant: GM Global Technology Operations LLC, Detroit, MI (US)

(72) Inventors: Darrell W. Burleigh, Fenton, MI (US); Christopher P. Musienko, Waterford, MI (US); Kenneth C. Swartz, Commerce Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 280 days.

(21) Appl. No.: 14/614,778

(22) Filed: Feb. 5, 2015

(65) Prior Publication Data

US 2016/0123254 A1 May 5, 2016

Related U.S. Application Data

(60) Provisional application No. 62/073,633, filed on Oct. 31, 2014.

(51) Int. Cl.
*F02D 41/00* (2006.01)
*F02M 25/08* (2006.01)
(Continued)

(52) U.S. Cl.
CPC ..... *F02D 41/004* (2013.01); *F02D 41/3082* (2013.01); *F02D 2041/2058* (2013.01);
(Continued)

(58) Field of Classification Search
CPC ..... F02D 41/004; F02D 41/3082; F02D 2041/2058; F02M 25/0836; F02M 25/0854; F02M 25/089
(Continued)

(56) References Cited

U.S. PATENT DOCUMENTS 5,080,078 A * 1/1992 Hamburg ..... F02M 25/08 123/519
5,273,020 A * 12/1993 Hayami ..... F02M 25/08 123/516
(Continued)

OTHER PUBLICATIONS

Garrod, David, Ph.D. Esq., "Glossary of Judicial Claim Constructions in the Electronics, Computer and Business Method Arts", Public Patent Foundation, Inc., 2010, pp. 256-257.

*Primary Examiner* — Stephen K Cronin
*Assistant Examiner* — Susan Scharpf

(57) ABSTRACT

A system according to the present disclosure includes a pump operating parameter module and a purge flow control module. The pump operating parameter module determines a value of an operating parameter of a purge pump that delivers purge fluid from a canister in an evaporative emissions system to an intake system of an engine. The operating parameter of the purge pump includes at least one of a speed of the purge pump, an amount of current supplied to the purge pump, and an amount of power supplied to the purge pump. The purge flow control module controls at least one of a purge valve and the purge pump to adjust an amount of purge fluid delivered to a cylinder of an engine based on the determined value of the operating parameter of the purge pump.

24 Claims, 4 Drawing Sheets

(51) Int. Cl.
*F02D 41/30* (2006.01)
*F02D 41/20* (2006.01)

(52) U.S. Cl.
CPC ..... *F02M 25/089* (2013.01); *F02M 25/0836* (2013.01); *F02M 25/0854* (2013.01)

(58) Field of Classification Search
USPC ..... 123/520; 701/102, 115
See application file for complete search history.

(56) References Cited

U.S. PATENT DOCUMENTS 5,957,113 A * 9/1999 Masaki ..... F02M 25/089 123/518
6,014,958 A * 1/2000 Miwa ..... F02D 41/0032 123/516
6,138,644 A * 10/2000 Saruwatari ..... F02M 25/08 123/519
2002/0121270 A1* 9/2002 Kano ..... F02M 25/08 123/520
2002/0162457 A1* 11/2002 Hyodo ..... F02M 25/089 96/109
2005/0229689 A1* 10/2005 Miyahara ..... F02M 25/08 73/114.41

* cited by examiner

SYSTEM AND METHOD FOR CONTROLLING THE AMOUNT OF PURGE FLUID DELIVERED TO CYLINDERS OF AN ENGINE BASED ON AN OPERATING PARAMETER OF A PURGE PUMP

CROSS-REFERENCE TO RELATED APPLICATIONS

This application claims the benefit of U.S. Provisional Application No. 62/073,633, filed on Oct. 31, 2014. The disclosure of the above application is incorporated herein by reference in its entirety.

FIELD

The present disclosure relates to internal combustion engines, and more particularly, to systems and methods for controlling the amount of purge fluid delivered to cylinders of an engine based on an operating parameter of a purge pump.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Evaporative emissions systems collect fuel vapor from a fuel tank and deliver the fuel vapor to an intake system for combustion in an engine. An evaporative emissions system typically includes a canister that absorbs fuel vapor from the fuel tank and a purge valve that controls the flow of fuel vapor from the canister to the intake system. Single path purge systems include a single path extending from the purge valve to the intake system. Dual path purge systems include two paths extending from the purge valve to the intake system.

Dual path purge systems are typically used for engine systems that include a boost device, such as a turbocharger, which pressurizes intake air provided to the engine. In these applications, dual path systems typically include a boosted path that provides fuel vapor to the intake system upstream from the boost device and a non-boosted path that provides fuel vapor to the intake system downstream from the boost device. In various dual path purge systems, the boosted path includes a jet pump that draws fuel vapor through the boosted path when the boost device is providing boost. The jet pump includes a first inlet in communication with the canister, a second inlet in communication with a location in the intake system downstream from the boost device, and an outlet in communication with the intake system upstream from the boost device.

SUMMARY

A system according to the present disclosure includes a pump operating parameter module and a purge flow control module. The pump operating parameter module determines a value of an operating parameter of a purge pump that delivers purge fluid from a canister in an evaporative emissions system to an intake system of an engine. The operating parameter of the purge pump includes at least one of a speed of the purge pump, an amount of current supplied to the purge pump, and an amount of power supplied to the purge pump. The purge flow control module controls at least one of a purge valve and the purge pump to adjust an amount of purge fluid delivered to a cylinder of an engine based on the determined value of the operating parameter of the purge pump.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
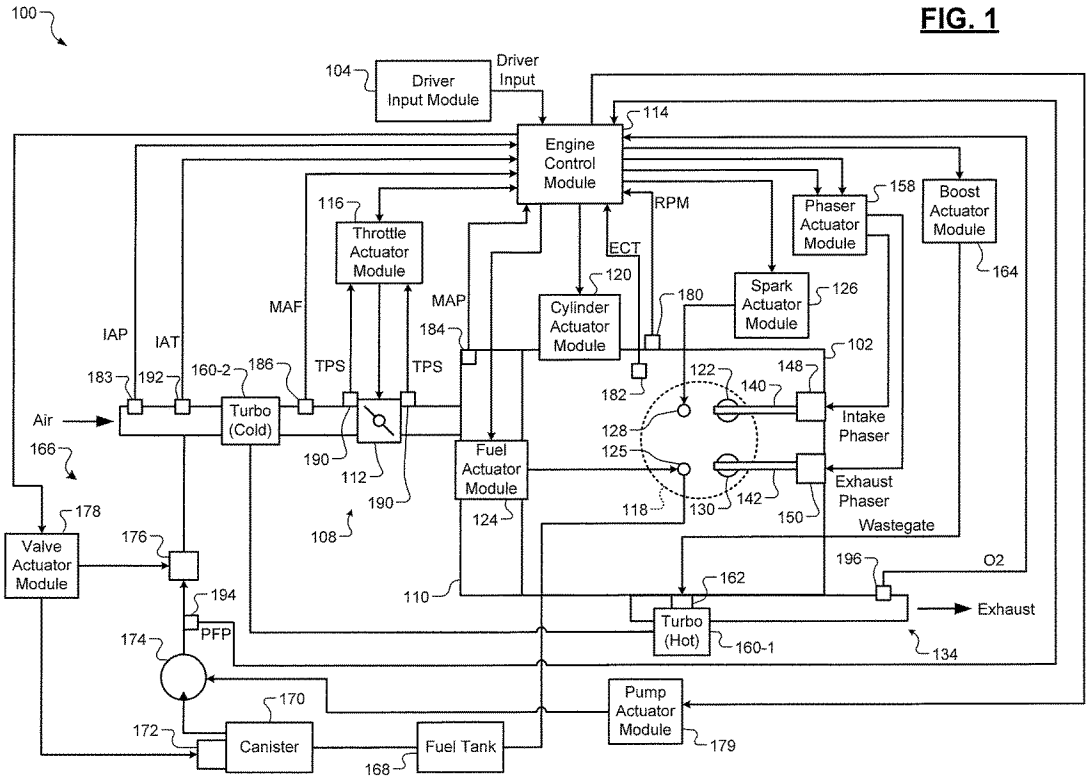
FIG. 1 is a functional block diagram of an example engine system according to the principles of the present disclosure.

Evaporative emissions systems for boosted (e.g., turbocharged) engines typically include a jet pump. The jet pump uses pressurized air in an intake system downstream from a boost device to create a vacuum that draws fuel vapor from a canister in the evaporative emissions system. The jet pump directs fuel vapor drawn from the canister to the intake system at a location upstream from the boost device.

Instead of using a jet pump, some evaporative emissions systems for boosted engines include an electric purge pump that sends fuel vapor from the canister to the intake system when the boost device is operating. When the boost device is not operating, a vacuum in the intake system may draw the fuel vapor from the canister into the intake system. Electric purge pumps are used in single flow path purge systems and dual flow path purge systems.

Engine control systems typically control the purge valve and/or the purge pump based on an assumed concentration of fuel in the purge fluid. Thus, if the actual concentration of fuel in the purge fluid is different from the assumed concentration, the amount of fuel delivered to the intake system may be more or less than desired. In turn, the air/fuel ratio of the engine may be too rich or too lean, which may cause drivability issues such as engine stalls due to a rich air/fuel ratio. To avoid drivability issues due to a rich air/fuel ratio, some engine control systems assume a worst-case (e.g., maximum) purge fuel concentration. Since the actual concentration is typically less than the worst-case concentration, the amount of purge fluid delivered to the intake system is typically less than the amount of purge fluid that may be delivered to the intake system without causing an engine stall.

Some engine control systems include a hydrocarbon sensor that measures the concentration of hydrocarbon fuel in purge fluid delivered to the intake system. These engine control systems avoid the drivability and purge control issues discussed above that are associated with an assumed concentration of fuel in the purge fluid. However, the cost of the hydrocarbon sensor may increase the cost of the vehicle.

A system and method according to the present disclosure accounts for changes in the concentration of fuel in purge fluid to avoid the drivability and purge control issues discussed above without using a hydrocarbon sensor to measure the concentration. The system and method accomplishes this by controlling the purge flow rate based on one or more operating parameters of the purge pump. To this end, the molecular weight of fuel vapor is approximately twice as much as the molecular weight of air. Thus, when a spike in the purge fuel concentration occurs, the speed of the purge pump may initially decrease due to the additional load on the purge pump, and then the power consumed by the purge pump may increase to maintain a target speed. The system and method adjusts the purge flow rate in response to these changes in the pump operating parameters to maintain a target air/fuel ratio. In addition, the system and method may determine the purge fuel concentration based on the pump operating parameters and adjust the purge flow rate based on the concentration determined.

Referring to FIG. 1, an engine system 100 includes an engine 102 that combusts an air/fuel mixture to produce drive torque for a vehicle based on driver input from a driver input module 104. The driver input may be based on a position of an accelerator pedal. The driver input may also be based on a cruise control system, which may be an adaptive cruise control system that varies vehicle speed to maintain a predetermined following distance.

Air is drawn into the engine 102 through an intake system 108. The intake system 108 includes an intake manifold 110 and a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates a fuel injector 125 to achieve a desired air/fuel ratio. The fuel injector 125 may inject fuel directly into the cylinders, as shown in FIG. 1, or into mixing chambers associated with the cylinders. In various implementations, the fuel injector 125 may inject fuel into the intake manifold 110 at a central location or at multiple locations, such as near the intake valve 122 of each of the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may deactivate the cylinder 118 by disabling opening of the intake valve 122 and/or the exhaust valve 130. In various implementations, the intake valve 122 and/or the exhaust valve 130 may be controlled by devices other than camshafts, such as electromagnetic or electrohydraulic actuators.

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift may also be controlled by the phaser actuator module 158.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

An evaporative emissions (EVAP) system 166 collects fuel vapor from a fuel tank 168 and delivers the fuel vapor to the intake system 108 for combustion in the engine 102. The EVAP system 166 includes a canister 170, a vent valve 172, a purge pump 174, and a purge valve 176. The canister 170 adsorbs fuel from the fuel tank 168. The vent valve 172 allows atmospheric air to enter the canister 170 when the vent valve 172 is open. The purge valve 176 allows purge fluid to flow from the canister 170 to the intake system 108 when the purge valve 176 is open. Purge fluid includes fuel vapor and air. Purge fluid may be introduced into the intake system 108 upstream from the compressor 160-2, as shown. Alternatively, purge fluid may be introduced into the intake system 108 downstream from the throttle valve 112, for example, on a non-boosted engine. The ECM 114 controls a valve actuator module 178, which regulates the positions of the vent valve 172 and the purge valve 176. The ECM 114 may open the vent valve 172 and the purge valve 176 to allow purge fluid to flow from the canister 170 to the intake system 108.

The purge pump 174 sends purge fluid from the canister 170 to the intake system 108. The purge pump 174 may be an electric pump. The purge pump 174 may be disposed upstream of the purge valve 176, as shown, or the purge pump 174 may be disposed upstream of the vent valve 172 in a flow path that places the canister 170 in communication with the atmosphere. The ECM 114 controls a pump actuator module 179, which regulates the output of the purge pump 174. In one example, the voltage supplied to the purge pump 174 may be a fixed (predetermined) value, and the pump actuator module 179 may regulate the output of the purge pump 174 by adjusting the amount of current supplied to the purge pump 174.

In various implementations, the EVAP system 166 may include more than one flow path extending from the canister 170 to the intake system 108. For example, the EVAP system 166 may include a first flow path and a second flow path. The first flow path may extend from the canister 170 to the intake system 108 at a location upstream from the compressor 160-2. The second flow path may extend from the first flow path to the intake system 108 at a location downstream from the throttle valve 112. In these implementations, the purge pump 174 may be used to send purge fluid to the intake system 108 through the first flow path when the boost device is operating (e.g., when the wastegate 162 is closed). In this regard, the first flow path may be referred as a boosted flow path. When the boost device is not operating (e.g., when the wastegate 162 is open), a vacuum in the intake system 108 may draw purge fluid from the canister 170 into the intake system 108 through the second flow path. In this regard, the second flow path may be referred to as a non-boosted flow path. In various implementations, the engine system 100 may include a normally aspirated engine having a single flow path purge system.

The engine system 100 may measure the position of the crankshaft using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure of intake air being drawn into the engine 102 may be measured using an intake air pressure (IAP) sensor 183. The pressure within the intake manifold 110 may be measured using a manifold absolute pressure (MAP) sensor 184. In various implementations, engine vacuum, which is the difference between the ambient air pressure and the intake manifold pressure, may be measured.

The mass flow rate of air flowing into the intake manifold 110 may be measured using a mass air flow (MAF) sensor 186. In various implementations, the MAF sensor 186 may be located in a housing that also includes the throttle valve 112. The throttle actuator module 116 may monitor the position of the throttle valve 112 using one or more throttle position sensors (TPS) 190. The temperature of ambient air being drawn into the engine 102 may be measured using an intake air temperature (IAT) sensor 192.

The pressure of purge fluid flowing from the canister 170 to the intake system 108 may be measured using a purge fluid pressure (PFP) sensor 194. The PFP sensor 194 may be disposed in the purge flow path at a location upstream from the purge pump 174, as shown. The concentration of oxygen in exhaust gas flowing through the exhaust system 134 may be measured using an oxygen (02) sensor 196. The ECM 114 uses signals from the sensors to make control decisions for the engine system 100.

Figure 2:
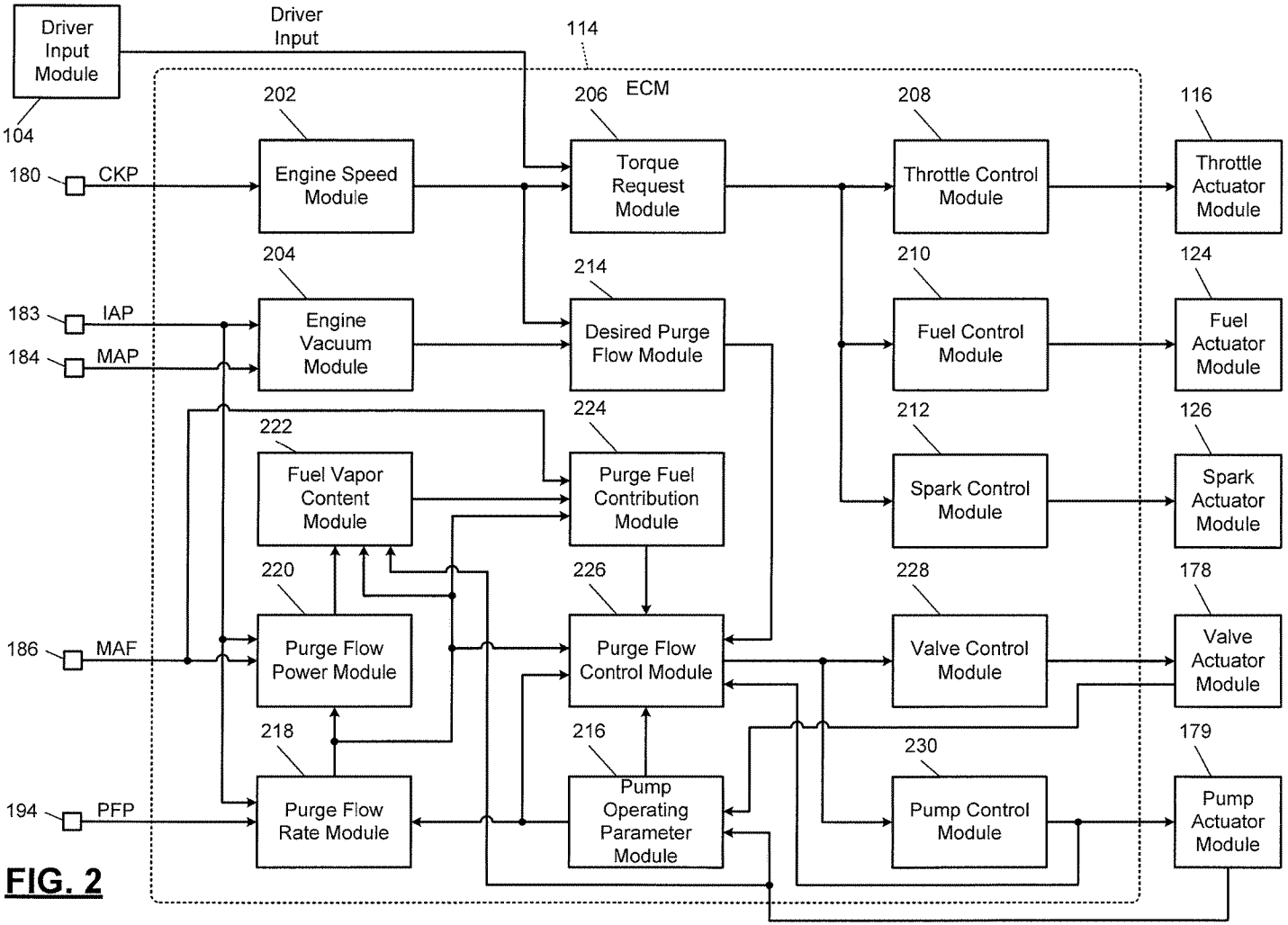
FIG. 2 is a functional block diagram of an example control system according to the principles of the present disclosure.

Referring now to FIG. 2, an example implementation of the ECM 114 includes an engine speed module 202, an engine vacuum module 204, and a torque request module 206. The engine speed module 202 determines engine speed. The engine speed module 202 may determine the engine speed based on the crankshaft position from the CKP sensor 180. For example, the engine speed module 202 may calculate the engine speed based on a period that elapses as the crankshaft completes one or more revolutions. The engine speed module 202 outputs the engine speed.

The engine vacuum module 204 determines engine vacuum. The engine vacuum module 204 may determine engine vacuum based on the atmospheric pressure from the IAP sensor 183 and the manifold pressure from the MAP sensor 184. The difference between the atmospheric pressure and the manifold pressure may be referred to as engine vacuum when the manifold pressure is less than the atmospheric pressure. The difference between the manifold pressure and the atmospheric pressure may be referred to as boost when the manifold pressure is greater than the atmospheric pressure. The engine vacuum module 204 outputs the engine vacuum (or boost).

The torque request module 206 determines a torque request based on the driver input from the driver input module 104. For example, the torque request module 206 may store one or more mappings of accelerator pedal position to desired torque and determine the torque request based on a selected one of the mappings. The torque request module 206 may select one of the mappings based on the engine speed and/or vehicle speed. The torque request module 206 outputs the torque request.

A throttle control module 208 controls the throttle valve 112 by instructing the throttle actuator module 116 to achieve a desired throttle area. A fuel control module 210 controls the fuel injector 125 by instructing the fuel actuator module 124 to achieve a desired injection amount and/or desired injection timing. A spark control module 212 controls the spark plug 128 by instructing the spark actuator module 126 to achieve desired spark timing.

The throttle control module 208 and the spark control module 212 may adjust the desired throttle area and the desired spark timing, respectively, based on the torque request from the torque request module 206. For example, the throttle control module 208 may increase or decrease the desired throttle area when the torque request increases or decreases, respectively. In another example, the spark control module 212 may advance or retard the spark timing when the torque request increases or decreases, respectively.

The fuel control module 210 may adjust the desired injection amount and/or the desired injection timing to achieve a desired air/fuel ratio such as a stoichiometric air/fuel ratio. For example, the fuel control module 210 may adjust the desired injection amount and/or the desired injection timing to minimize a difference between an actual air/fuel ratio and the desired air/fuel ratio. The fuel control module 210 may determine the actual air/fuel ratio based on the oxygen level from the O2 sensor 196. Controlling the air/fuel ratio in this way may be referred to as closed-loop control of the air/fuel ratio.

The oxygen level measured by the O2 sensor 196 may not be accurate when the temperature of the O2 sensor 196 is less than an activation temperature, such as when the engine 102 is initially started after then engine 102 has been shutdown for a period. Thus, the fuel control module 210 may adjust the desired injection amount and/or the desired injection timing independent of the oxygen level measured by the O2 sensor 196. For example, the fuel control module 210 may adjust the desired injection amount and/or the desired injection timing based on the mass flow rate of intake air from the MAF sensor 186 in order to achieve the desired air/fuel ratio. Controlling the air/fuel ratio in this way may be referred to as open-loop control of the air/fuel ratio.

A desired purge flow module 214 determines a desired purge flow rate. The desired purge flow module 214 may determine the desired purge flow rate based on the engine vacuum and/or the engine speed. The desired purge flow module 214 outputs the desired purge flow rate.

A pump operating parameter module 216 determines one or more operating parameters of the purge pump 174 and outputs the operating parameters. The operating parameters may include the speed of the purge pump 174, the amount of current supplied to the purge pump 174, and/or the amount of power supplied to the purge pump 174. The pump operating parameter module 216 may receive the pump speed and the pump current from the pump actuator module 179. The pump operating parameter module 216 may determine the product of the pump current and the pump voltage to obtain the pump power. The pump voltage may be a predetermined value. The pump actuator module 179 may output measured values of the pump speed and the pump current and/or target values of the pump speed and pump current.

A purge flow rate module 218 determines a first flow rate of purge fluid flowing through the purge pump 174 and outputs the first flow rate. The purge flow rate module 218 may divide the pump power by a pressure difference across the purge pump 174 to obtain the first flow rate. The pressure difference across the purge pump 174 is a difference between a first pressure upstream from the purge pump 174 and a second pressure downstream from the purge pump 174. The purge flow rate module 218 may determine and output the pressure difference across the purge pump 174. The purge flow rate module 218 may assume that the first pressure is approximately equal to ambient pressure, which may be received from an ambient pressure sensor or approximated based on the intake air pressure from the IAP sensor 183. The purge flow rate module 218 may receive the second pressure from the PFP sensor 194.

The purge flow rate module 218 also determines a second flow rate of purge fluid flowing through the purge valve 176 and outputs the second flow rate. The purge flow rate module 218 may divide the mass flow rate of purge fluid flowing through the purge valve 176 by the density of the purge fluid to obtain the second flow rate. The purge flow rate module 218 may assume that the density of the purge fluid is equal to the density of air, which may be predetermined. The purge flow rate module 218 may determine the mass flow rate of the purge fluid flowing through the purge valve 176 based on a relationship such as $$\dot{m}_{pf} = \frac{C_D A_{pv} p_0}{\sqrt{RT_0}} \left(\frac{p_{pf}}{p_0}\right)^{1/\gamma} \left\{ \frac{2\gamma}{\gamma - 1} \left[ 1 - \left(\frac{p_{pf}}{p_0}\right)^{(\gamma-1)/\gamma} \right] \right\}^{1/2} \tag{1}$$

where $rh_{pf}$ is the mass flow rate of the purge fluid, $C_D$ is a flow or discharge coefficient, $A_{pv}$ is the opening area of the purge valve 176, $p_0$ is a stagnation pressure, R is an ideal gas constant, $T_0$ is a stagnation temperature, $p_{pf}$ is the purge fluid pressure from the PFP sensor 194, and $\gamma$ is an isentropic expansion factor. The discharge coefficient, the stagnation pressure, the ideal gas constant, the stagnation temperature, and the isentropic expansion factor may be predetermined. The opening area of the purge valve 176 may be received from the valve actuator module 178.

The purge flow power module 220 determines the amount of power associated with the purge fluid flowing through the purge valve 176 and outputs the purge flow power. The purge flow power module 220 may determine the product of the purge flow rate and a pressure difference across the purge valve 176 to obtain the purge flow power. The pressure difference across the purge valve 176 is a difference between a first pressure upstream from the purge valve 176 and a second pressure downstream from the purge valve 176. The purge flow power module 220 may receive the first pressure from the PFP sensor 194. The purge flow power module 220 may receive the second pressure from the IAP sensor 183. Alternatively, the purge flow power module 220 may estimate the second pressure based on barometric pressure and the mass flow rate of intake air from the MAF sensor 186, or assume that the second pressure is equal to barometric pressure.

The fuel vapor content module 222 determines the amount or content of fuel vapor in the purge fluid flowing through the purge valve 176 based on the pump power. The fuel vapor content may be expressed as a concentration (e.g., a ratio of the mass of the fuel vapor to the total volume of fuel vapor and air in the purge fluid) or a mass fraction (e.g., a ratio of the mass of the fuel vapor to the total mass of the purge fluid). The fuel vapor content module 222 may determine the fuel vapor content based on a predetermined relationship between the first flow rate of purge fluid flowing through the purge pump 174, the second flow rate of purge fluid flowing through the purge valve 176, and the fuel vapor content. The predetermined relationship may be embodied in a lookup table, which may map a difference between the first and second flow rates, or a ratio thereof, to the fuel vapor content.

The fuel vapor content module 222 may determine the fuel vapor content based on a predetermined relationship between an expected efficiency of the purge pump 174, an estimated efficiency of the purge pump 174, and the fuel vapor content. The predetermined relationship may be embodied in a lookup table. The fuel vapor content module 222 may determine the expected efficiency of the purge pump 174 based on one or more operating conditions of the purge pump 174. The operating conditions may include the pump speed, the purge flow rate, the pressure difference across the purge pump 174, and/or the pump current. The fuel vapor content module 222 may divide the purge flow power by the purge pump power to obtain the estimated efficiency of the purge pump 174. The fuel vapor content module 222 outputs the fuel vapor content.

The fuel vapor content module 222 may use a lookup table to determine the fuel vapor content based on a difference between the mass flow rate of purge fluid flowing through the purge valve 176 and a mass flow rate of purge fluid flowing through the purge pump 174. The purge flow rate module 218 may determine the mass flow rate of purge fluid flowing through the purge pump 174 using a relationship such as $$r\dot{m}_{PP}=[(\mu_{est}*\rho_{pf}*P_{pp})/\Delta p_{pp}] \quad (2)$$

where $r\dot{M}_{PP}$ is the mass flow rate of the purge pump 174, $\mu_{est}$ is the estimated efficiency of the purge pump 174, $\rho_{pf}$ is the density of the purge fluid, $P_{pp}$ is the pump power, and $\Delta P_{pp}$ is the pressure difference across the purge pump 174. The purge flow rate module 218 may assume that the density of the purge fluid is equal to the density of air, which may be predetermined.

The fuel vapor content module 222 may use a lookup table to determine the fuel vapor content based on a difference between the actual pump current and a pump current that is estimated based on the mass flow rate of purge fluid flowing through the purge valve 176. The fuel vapor content module 222 may assume that the actual pump current is equal to a target pump current or a measured pump current. The fuel vapor content module 222 may divide the purge flow power by the fixed voltage of the purge pump 174 to obtain the estimated pump current. The fuel vapor content module 222 may filter the fuel vapor content using a first-order lag filter to reduce the effect of abrupt changes in the fuel vapor content.

The purge fuel contribution module 224 determines the contribution of fuel in the purge fluid flowing through the purge valve to a total amount of fuel delivered to the cylinders of the engine 102. To determine the purge fuel contribution, the purge fuel contribution module 224 may divide a first mass flow rate of air by a total mass flow rate of air delivered to the cylinders. The first mass flow rate is a mass flow rate of air supplied by fuel from the purge fluid to yield a desired air/fuel ratio such as a stoichiometric air/fuel ratio. The purge fuel contribution module 224 may determine a product of a mass flow rate of fuel in the purge fluid and the desired air/fuel ratio to obtain the first mass flow rate. To determine the mass flow rate of fuel in the purge fluid, the purge fuel contribution module 224 may determine a product of the mass flow rate of the purge fluid and the mass fraction corresponding to the fuel vapor content.

The purge fuel contribution module 224 may determine a sum of the mass flow rate of intake air from the MAF sensor 186 and a mass flow rate of air in the purge fluid to obtain the total mass flow rate of air delivered to the cylinders. The purge fuel contribution module 224 may determine the mass flow rate of air in the purge fluid by multiplying the mass flow rate of the purge fluid by the result of one minus the mass fraction corresponding to the fuel vapor content.

A purge flow control module 226 controls the flow rate of purge fluid introduced into the intake system 108 of the engine 102. The purge flow control module 226 may control the purge flow rate by instructing a valve control module 228 to adjust the opening area of the purge valve 176 and/or instructing a pump control module 230 to adjust the output of the purge pump 174. The valve control module 228 controls the purge valve 176 by instructing the valve actuator module 178 to achieve a desired opening area. The pump control module 230 controls the purge pump 174 by instructing the pump actuator module 179 to achieve a desired pump output.

The purge flow control module 226 may control the purge flow rate to minimize a difference between the purge flow rate determined by the purge flow rate module 218 and the desired purge flow rate determined by the desired purge flow module 214. Additionally or alternatively, the purge flow control module 226 may control the purge flow rate to ensure that the purge fuel contribution determined by the purge fuel contribution module 224 does not exceed a desired purge fuel contribution. The desired purge fuel contribution may be predetermined and/or determined based on targets for emission levels and purge control strategies.

Figure 3:
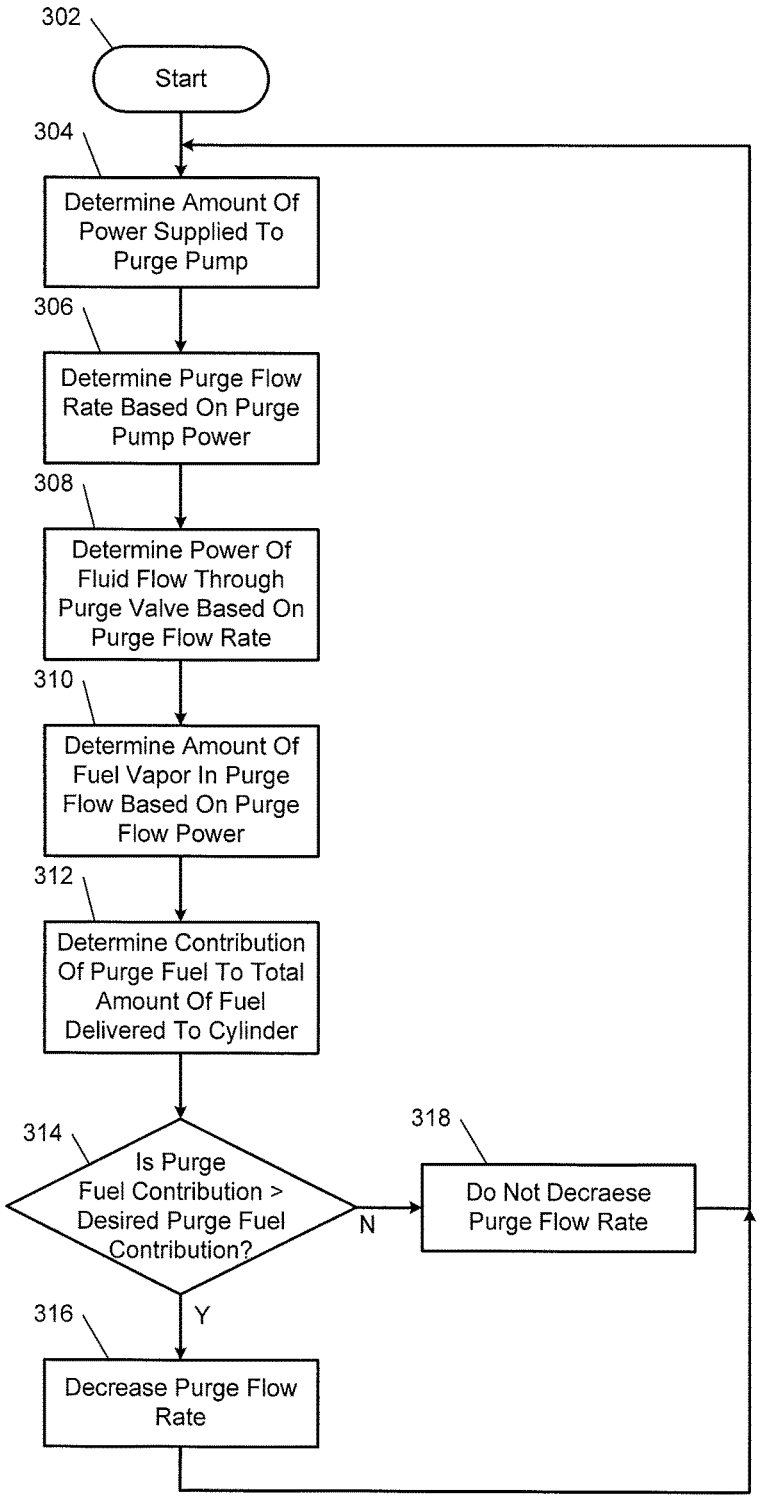
FIGS. 3 and 4 are flowcharts illustrating an example control method according to the principles of the present disclosure.

Referring now to FIG. 3, a method for controlling the amount of purge fluid delivered to cylinders of the engine 102 based on an operating parameter of the purge pump 174 begins at 302. The method is described in the context of the modules included in the example implementation of the ECM 114 shown in FIG. 2 to further describe the functions performed by those modules. However, the particular modules that perform the steps of the method may be different than the description below and/or the method may be implemented apart from the modules of FIG. 2. For example, the method may be implemented by one module or more than two modules.

At 304, the pump operating parameter module 216 determines the amount of power supplied to the purge pump 174. At 306, the purge flow rate module 218 determines the first flow rate of purge fluid flowing through the purge pump 174 based on the pump power and determines the second flow rate of purge fluid flowing through the purge valve 176. At 308, the purge flow power module 220 determines the power of purge fluid flowing through the purge valve 176 based on the second flow rate. At 310, the fuel vapor content module 222 determines the amount of fuel vapor in the purge fluid flowing through the purge valve 176 based on the purge flow power. At 312, the purge fuel contribution module 224 determines the contribution of fuel in the purge fluid to the total amount of fuel delivered to the cylinders of the engine 102.

At 314, the purge flow control module 226 determines whether the purge fuel contribution is greater than the desired purge fuel contribution. If the purge fuel contribution is greater than the desired purge fuel contribution, the purge flow control module 226 continues at 316 and decreases the purge flow rate. Otherwise, the purge flow control module 226 continues at 318 and does not decrease the purge flow. rate.

Figure 4:
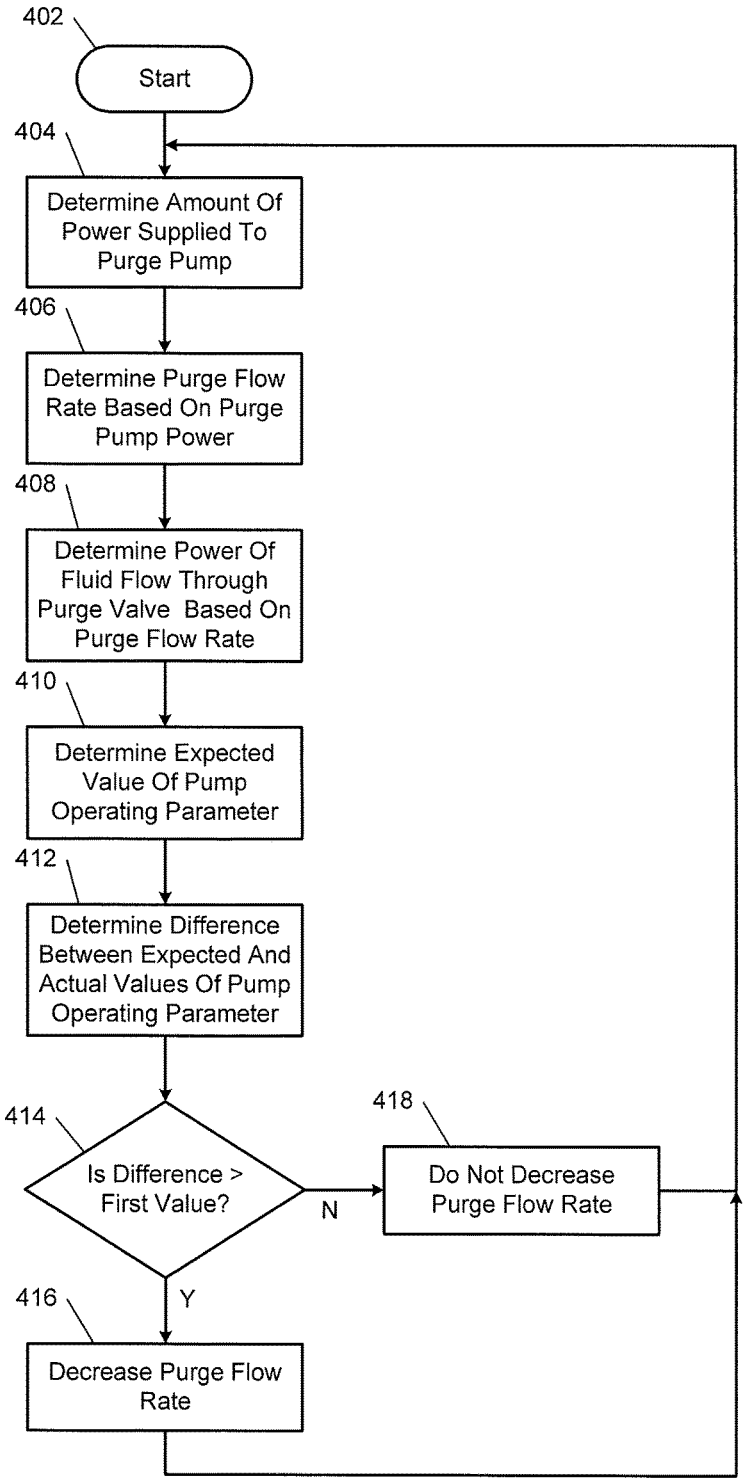

Referring now to FIG. 4, another method for controlling the amount of purge fluid delivered to cylinders of the engine 102 based on an operating parameter of the purge pump 174 begins at 402. The method of FIG. 3 may be primarily used to determine the purge fuel contribution and control the purge flow rate in response to gradual changes in the purge fuel contribution. The method of FIG. 4 may be primarily used to minimize or prevent large spikes in the purge flow rate such as those that may occur when fuel sloshes in the fuel tank 168 or when the purge valve 176 is opened. The method of FIG. 4 may be performed in conjunction with the method of FIG. 3, in which case steps of the two methods that are the same may be executed only once. Alternatively, the method of FIG. 4 may be performed without performing the method of FIG. 3, which may save processing power that may otherwise be used to determine the purge fuel contribution.

The method of FIG. 4 is described in the context of the modules included in the example implementation of the ECM 114 shown in FIG. 2 to further describe the functions performed by those modules. However, the particular modules that perform the steps of the method may be different than the description below and/or the method may be implemented apart from the modules of FIG. 2. For example, the method may be implemented by one module or more than two modules.

At 404, the pump operating parameter module 216 determines the amount of power supplied to the purge pump 174. At 406, the purge flow rate module 218 determines the first flow rate of purge fluid flowing through the purge pump 174 based on the pump power and determines the second flow rate of purge fluid flowing through the purge valve 176. At 408, the purge flow power module 220 determines the power of purge fluid flowing through the purge valve 176 based on the second flow rate.

At 410, the purge flow control module 226 determines an expected value of one or more of the operating parameters of the purge pump 174. For example, the purge flow control module 226 may determine an expected pump speed, an expected pump current, and/or an expected pump power. The purge flow control module 226 may set the expected value of the pump operating parameters equal to corresponding target value of the pump operating parameters. For example, the purge flow control module 226 may set the expected pump speed, the expected pump current, and the expected pump power equal to a target pump speed, a target pump current, and a target pump power, respectively. The purge flow control module 226 may receive the target value from the pump control module 230.

At 412, the purge flow control module 226 determines a difference between the expected value of a pump operating parameter and an actual value of the pump operating parameter. The purge flow control module 226 may receive the actual value of the pump operating parameter from the pump operating parameter module 216. The actual values of the pump speed and the pump current may be values measured by the pump actuator module 179. The actual value of the pump power may be the value of the pump power determined by the pump operating parameter module 216 based on the fixed value of the pump voltage and the measured value of the pump current.

At 414, the purge flow control module 226 determines whether the difference between the expected and actual values of the pump operating parameter is greater than a first value. The first value may be determined based on the pump speed and the mass flow rate of purge fluid flowing through the purge valve 176 using a lookup table. If the difference between the expected and actual values of the pump operating parameter is greater than the first value, the purge flow control module 226 continues at 416 and decreases the purge flow rate. Otherwise, the purge flow control module 226 continues at 418 and does not decrease the purge flow rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a pump operating parameter module that determines an operating parameter of a purge pump that delivers purge fluid from a canister in an evaporative emissions system to an intake system of an engine, wherein the operating parameter of the purge pump includes at least one of a speed of the purge pump, an amount of current supplied to the purge pump, and an amount of power supplied to the purge pump;

a fuel vapor content module that determines a fuel vapor content of the purge fluid based on at least one of the operating parameter of the purge pump and a pressure downstream of the purge pump, wherein the fuel vapor content is a ratio of an amount of fuel vapor in the purge fluid to an amount of the purge fluid; and a purge flow control module that controls at least one of a purge valve and the purge pump to adjust an amount of purge fluid delivered to a cylinder of the engine based on the fuel vapor content.

2. The system of claim 1 wherein the operating parameter of the purge pump includes the amount of power supplied to the purge pump.

3. The system of claim 2 further comprising a purge flow rate module that determines a first flow rate of purge fluid flowing through the purge pump based on the purge pump power and determines a second flow rate of purge fluid flowing through the purge valve based on a purge fluid pressure.

4. The system of claim 3 further comprising a purge flow power module that determines a power associated with the purge fluid flowing through the purge valve based on the second flow rate and a pressure difference across the purge valve.

5. The system of claim 4 wherein the fuel vapor content module determines the fuel vapor content based on the purge pump power and the purge flow power.

6. The system of claim 5 further comprising a purge fuel contribution module that determines a contribution of the fuel in the purge fluid flowing through the purge valve to a total amount of fuel delivered to the cylinder based on the fuel vapor content.

7. The system of claim 6 wherein the purge flow control module decreases the amount of purge fluid flowing through the purge valve when the purge fuel contribution is greater than a predetermined value.

8. The system of claim 1 wherein the fuel vapor content module determines the fuel vapor content based on the speed of the purge pump and at least one of the amount of power supplied to the purge pump and the pressure downstream of the purge pump.

9. The system of claim 8 wherein the fuel vapor content module determines the fuel vapor content further based on a flow rate of the purge fluid.

10. The system of claim 3 wherein the fuel vapor content module determines the fuel vapor content based on the first flow rate and the second flow rate.

11. A method comprising:

determining a value of an operating parameter of a purge pump that delivers purge fluid from a canister in an evaporative emissions system to an intake system of an engine, wherein the operating parameter of the purge pump includes at least one of a speed of the purge pump, an amount of current supplied to the purge pump, and an amount of power supplied to the purge pump;

determining a fuel vapor content of the purge fluid based on at least one of the operating parameter of the pump and a pressure downstream of the purge pump, wherein the fuel vapor content is a ratio of an amount of fuel vapor in the purge fluid to an amount of the purge fluid; and controlling at least one of a purge valve and the purge pump to adjust an amount of purge fluid delivered to a cylinder of the engine based on the fuel vapor content.

12. The method of claim 11 wherein the operating parameter of the purge pump includes the amount of power supplied to the purge pump.

13. The method of claim 12 further comprising:

determining a first flow rate of purge fluid flowing through the purge pump based on the purge pump power; and determining a second flow rate of purge fluid flowing through the purge valve based on a purge fluid pressure.

14. The method of claim 13 further comprising determining a power associated with the purge fluid flowing through the purge valve based on the second flow rate and a pressure difference across the purge valve.

15. The method of claim 14 further comprising determining the fuel vapor content based on the purge pump power and the purge flow power.

16. The method of claim 15 further comprising determining a contribution of the fuel in the purge fluid flowing through the purge valve to a total amount of fuel delivered to the cylinder based on the fuel vapor content.

17. The method of claim 16 further comprising decreasing the amount of purge fluid flowing through the purge valve when the purge fuel contribution is greater than a predetermined value.

18. The method of claim 11 further comprising determining the fuel vapor content based on the speed of the purge pump and at least one of the amount of power supplied to the purge pump and the pressure downstream of the purge pump.

19. The method of claim 18 further comprising determining the fuel vapor content further based on a flow rate of the purge fluid.

20. The method of claim 13 further comprising determining the fuel vapor content based on the first flow rate and the second flow rate.

21. A system comprising:

a pump operating parameter module that determines a value of an operating parameter of a purge pump that delivers purge fluid from a canister in an evaporative emissions system to an intake system of an engine, wherein the operating parameter of the purge pump includes at least one of a speed of the purge pump, an amount of current supplied to the purge pump, and an amount of power supplied to the purge pump; and a purge flow control module that:

determines a difference between the determined value of the operating parameter of the purge pump and a commanded value of the operating parameter; and controls at least one of a purge valve and the purge pump to decrease an amount of purge fluid delivered to a cylinder of the engine when the difference is greater than a first value, indicating a change in an amount of fuel vapor in purge fluid flowing through the purge valve.

22. The system of claim 21 wherein the purge flow control module determines the first value based on the speed of the purge pump and a flow rate of purge fluid flowing through the purge valve.

23. A method comprising:

determining a value of an operating parameter of a purge pump that delivers purge fluid from a canister in an evaporative emissions system to an intake system of an engine, wherein the operating parameter of the purge pump includes at least one of a speed of the purge pump, an amount of current supplied to the purge pump, and an amount of power supplied to the purge pump;

determining a difference between the determined value of the operating parameter of the purge pump and a commanded value of the operating parameter; and controlling at least one of a purge valve and the purge pump to decrease an amount of purge fluid delivered to a cylinder of the engine when the difference is greater than a first value, indicating a change in an amount of fuel vapor in purge fluid flowing through the purge valve.

24. The method of claim 23 further comprising determining the first value based on the speed of the purge pump and a flow rate of purge fluid flowing through the purge valve.

* * * * *